United States Patent [19]

Reinmold et al.

[11] Patent Number: 4,648,210

[45] Date of Patent: Mar. 10, 1987

[54] APPARATUS FOR CONTROLLING POSITION OF GRINDING TOOL

[75] Inventors: Heinz-Josef Reinmold; Horst Mucha, both of Aachen; Heinz-Dieter Friedrich, Stolberg, all of Fed. Rep. of Germany

[73] Assignee: Saint-Gobain Vitrage, Courbevoie, France

[21] Appl. No.: 749,959

[22] Filed: Jun. 27, 1985

[30] Foreign Application Priority Data

Jun. 30, 1984 [DE] Fed. Rep. of Germany ..... 3424258

[51] Int. Cl.[4] ..... B24B 49/08

[52] U.S. Cl. ..... 51/165.77; 51/169.92; 51/105 EC

[58] Field of Search ..... 51/165.77, 165.9, 165.92, 51/105 EC

[56] References Cited

U.S. PATENT DOCUMENTS

| | | | |
|---|---|---|---|
| 3,062,996 | 12/1962 | Ertell et al. . | |
| 3,100,954 | 8/1963 | Di Lella . | |
| 3,274,736 | 9/1966 | Brokaw . | |
| 3,553,903 | 1/1971 | Christie . | |
| 3,641,711 | 2/1972 | Halberschmidt et al. . | |
| 3,672,100 | 6/1972 | Pesante | 51/165.77 |
| 3,827,189 | 8/1974 | Highberg et al. . | |
| 3,939,610 | 8/1976 | Suzuki | 51/165.77 |
| 4,075,792 | 2/1978 | Schreiber | 51/165.92 |
| 4,171,657 | 10/1979 | Halberschmidt et al. . | |
| 4,228,617 | 10/1980 | Bando . | |
| 4,375,738 | 3/1983 | Bando . | |
| 4,519,167 | 5/1985 | Halberschmidt et al. . | |

FOREIGN PATENT DOCUMENTS

| | | |
|---|---|---|
| 0084506 | 7/1983 | European Pat. Off. . |
| 2437010 | 2/1976 | Fed. Rep. of Germany . |
| 1387113 | 3/1971 | United Kingdom . |

*Primary Examiner*—Harold D. Whitehead
*Attorney, Agent, or Firm*—Pennie & Edmonds

[57] ABSTRACT

Apparatus is disclosed for grinding the edges of a glass sheet which is positioned on a motor driven rotary table. The apparatus includes a grinding disc mounted to rotate in a toolholder which may be moved in relation to the axis of rotation of the rotary table by a constant torque motor so as to apply a constant grinding pressure between the grinding tool and the glass sheet. A plurality of manometer capsules or other pressure measuring devices whose voltage outputs depend on applied pressure, are used to produce signals to regulate the constant grinding force. The toolholder is movably mounted on a larger positioning carriage which can also be moved in relation to the axis of rotation of the rotating table in order to compensate for irregular glass sheet shapes. This positioning is effected by signals from a distance to voltage converter fed into an adjustment circuit which drives a positioning motor.

12 Claims, 4 Drawing Figures

APPARATUS FOR CONTROLLING POSITION OF GRINDING TOOL

BACKGROUND OF THE INVENTION

The present invention relates to a method and apparatus for controlling the position of a grinding tool. A specific embodiment of the invention is implemented in an apparatus for grinding the edge of a glass sheet mounted on a rotary table.

An apparatus of this type is described in patent document EP 0 084 506 which is incorporated herein by reference. In that document, position control of the grinding tool is achieved by a positioning motor controlled by a sensor that scans the edge of the glass sheet ahead of the grinding tool. The sensor provides control signals which are stored in a shift register and used as set points to an adjustment amplifier when the rotary table has traveled the angular distance between the points of contact of the glass sheet with the scanning sensor and the grinding tool With such a grinding machine, this angular distance must initially be traversed by the sensor to program the shift register before the grinding operation starts. As a result, the total time of a grinding cycle is increased by the time necessary for this prior programming. Moreover, such a grinding machine necessitates the use of an edge sensor.

SUMMARY OF THE INVENTION

An object of the present invention is an edge grinding machine having shorter grinding cycles and consequently increased production capacity. This is accomplished through more simple and direct means for controlling the grinding tool. The invention does not require any prior programming involving the shape of the glass to be ground.

In a preferred embodiment of the device, the glass sheet to be ground is fastened to a rotary table. The grinding tool is mounted on a toolholder carriage which is supported by rails attached to a positioning carriage. The toolholder carriage can be shifted linearly on the positioning carriage by a constant torque motor in a direction towards the rotational axis of the rotary table. The motor maintains a constant pressure on the glass sheet.

A plurality of manometer capsules or other pressure measuring devices are inserted between the toolholder carriage and the positioning carriage to measure the magnitude and direction of the force between the grinding tool and the glass sheet. An adjustment circuit uses signals from these pressure measuring devices to control a constant torque motor so as to apply constant pressure to the glass sheet regardless of its shape.

The positioning carriage is also shiftable in a direction towards the rotational axis of the rotary table so as to compensate for irregular glass shapes. The positioning carriage is controlled by a distance to voltage converter which determines the relative movement between the toolholder carriage and the positioning carriage. The converter produces an output voltage which serves as a regulating value for a positioning motor for the positioning carriage. The distance to voltage converter may comprise a linear potentiometer, the resistance body of which is mounted on the positioning carriage and the wiper of which is mounted on the toolholder.

The position of the grinding tool is thus controlled exclusively by the actual grinding pressure. As soon as this actual grinding pressure changes in relation to a preselected set point because of rotation of the glass sheet, the grinding pressure motor reacts so as to maintain a constant grinding pressure, and the positioning motor will then also react to move the positioning carriage so as to permit the grinding tool to properly follow the edge of the glass sheet and also to permit the toolholder to center on the positioning carriage. As a result, the linear movements of the toolholder and the positioning carriage are superimposed in this first embodiment.

In another preferred embodiment of the invention, the grinding tool is mounted at one end of a swinging arm whose position in relation to the axis of rotation of the rotary table supporting the glass sheet is adjusted so as to conform to the shape of the rotating glass sheet. This swinging arm is mounted on the rotor of a constant torque motor acting as a constant pressure device and whose body is mounted on a positioning plate rotated by a positioning motor. The swinging arm and the positioning plate in this embodiment are analogous to the toolholder and the positioning carriage, respectively, of the first embodiment.

The adjustment circuit again comprises a plurality of manometer capsules which are placed between the swinging arm and the grinding tool, whereby control signals are fed to an adjustment circuit so that the constant torque motor will apply constant pressure to the glass sheet regardless of its shape. In this case, the movements of the two systems swinging about the same axis are also superimposed to define the movement of the grinding tool.

This edge grinding machine is suitable for grinding the edges of glass sheets of different shapes and requires no additional arrangements for storage of the path of the positioning motor. Precise positional control of the grinding tool is accomplished in a safe and simple manner and with a relatively high sensitivity of the control circuit. Positional control is dependent on grinding pressure alone, without the need of an edge sensor mounted ahead of the grinding tool.

BRIEF DESCRIPTION OF THE DRAWINGS

These and other objects, features and advantages of the invention will become more readily apparent with reference to the following description of a preferred embodiment of the invention in which.

DETAILED DESCRIPTION OF THE INVENTION

Figure 1:
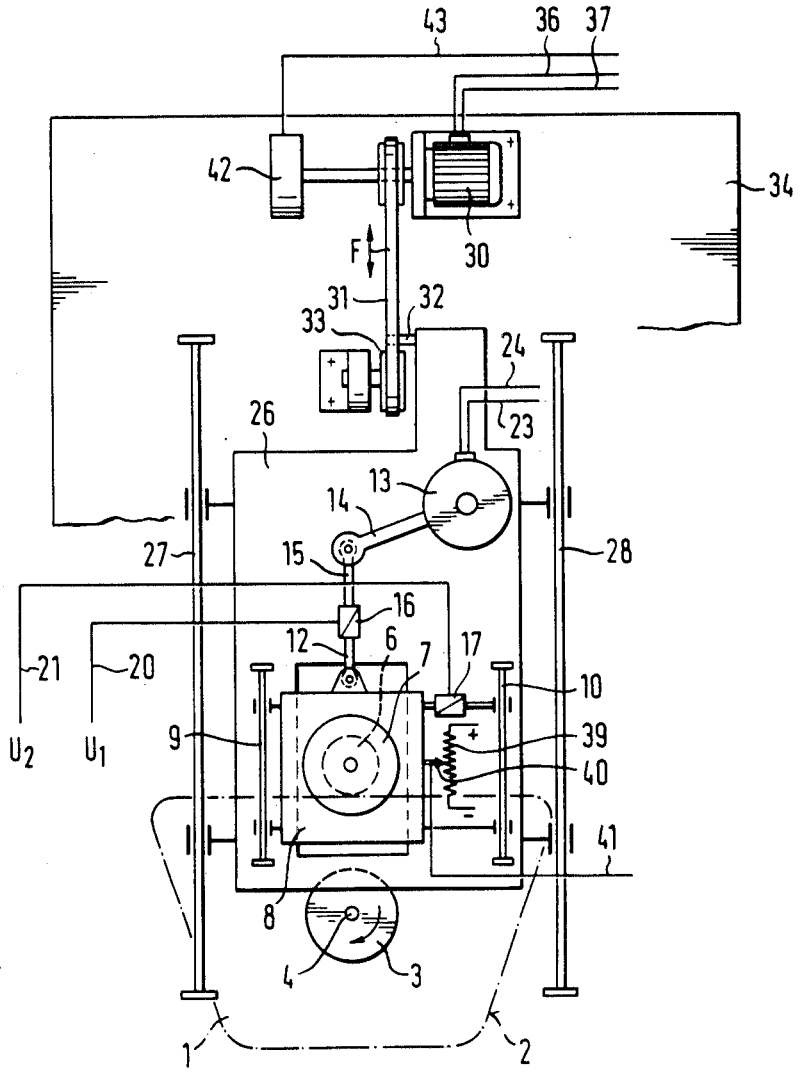
FIG. 1 is a top view of a grinding machine according to one embodiment of the invention in which a grinding tool is mounted for linear movement.
Figure 2:
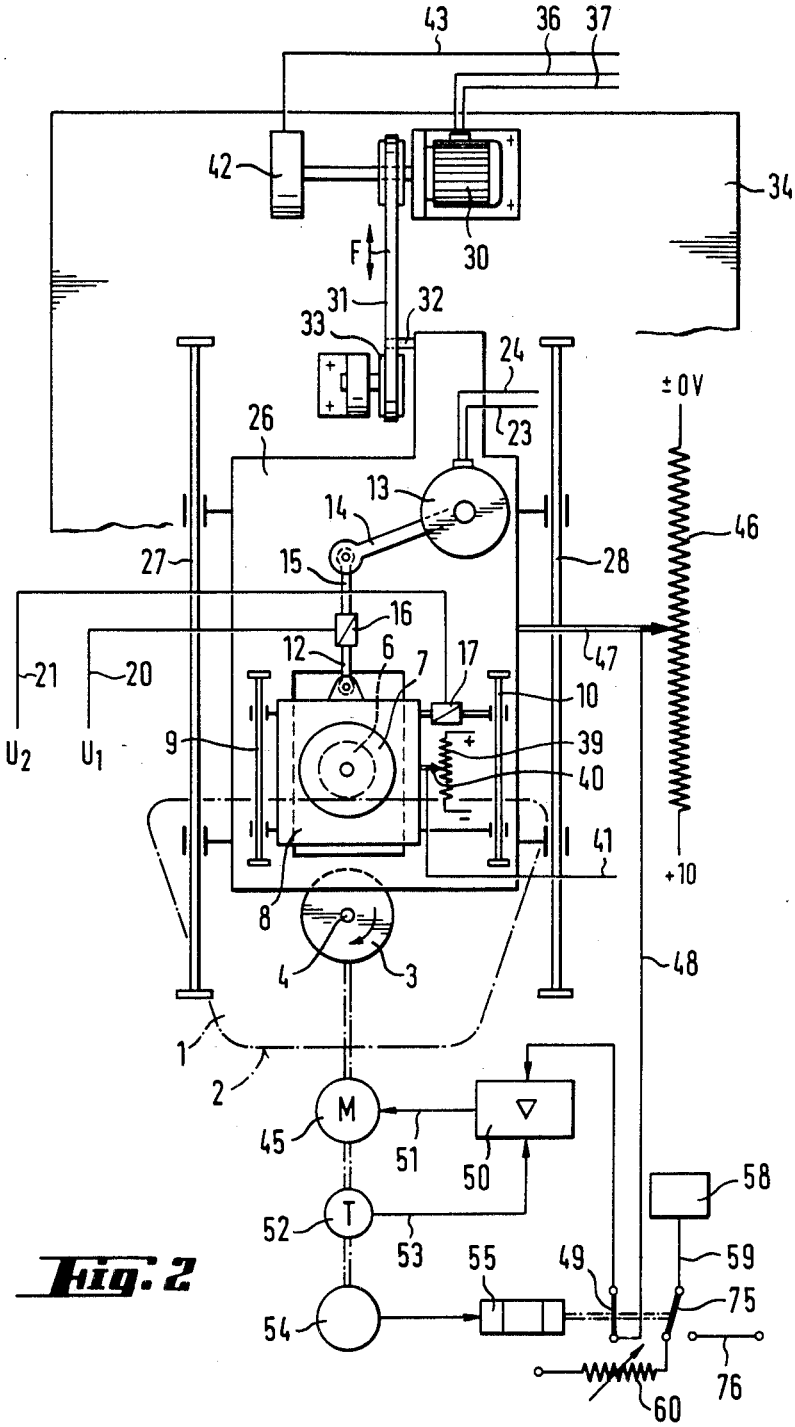
FIG. 2 depicts a modification of the apparatus of FIG. 1 to provide an additional adjustment circuit for a motor that drives a rotary table carrying glass sheets.
Figure 4:
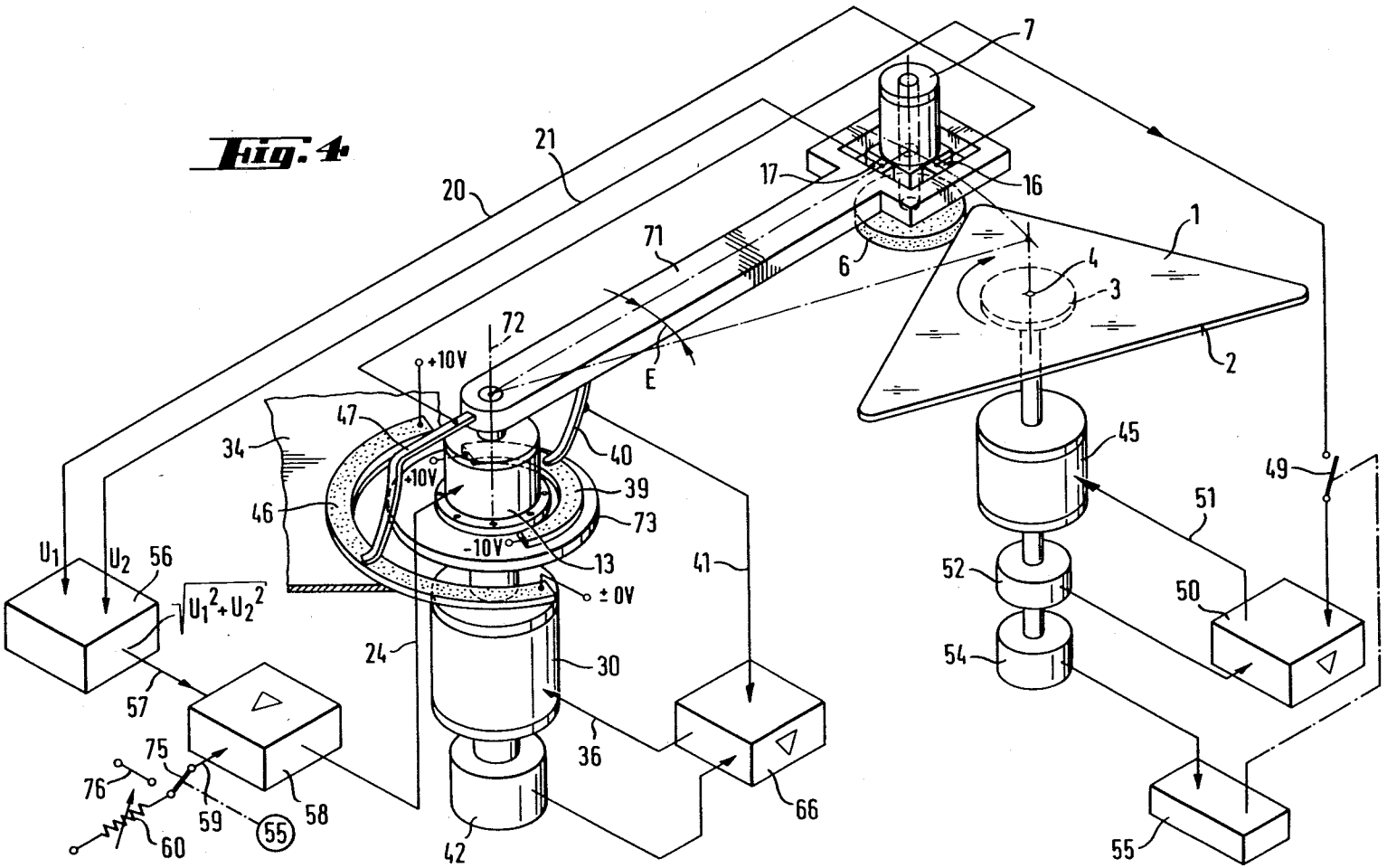
FIG. 4 is a perspective view, partially broken away, of a grinding machine according to another embodiment of the invention with the grinding tool mounted on a swinging arm.

As shown in FIGS. 1, 2 and 4, a glass sheet 1 is fastened for grinding on a rotary table 3 which is rotated around an axis 4 by a driving motor 45 (FIGS. 2 and 4). With reference to FIGS. 1 and 2, a grinding tool comprising a grinding wheel 6 driven by a motor shaft 7 is mounted on a toolholder carriage or sled 8 so that it engages an edge 2 of glass sheet 1. Carriage 8 rides on rails 9, 10 so that it may be linearly shifted in a radial direction relative to the axis of rotation 4 of rotary table 3. Alternatively, rails 9, 10 can be replaced by any other system assuring a linear or approximately linear movement without much friction. For example, carriage 8 can be placed on hinged parallelograms, with the sliding bearings on the hinged parallelogram. Rails 9, 10, in turn, are mounted on a positioning carriage 26 which rides on rails 27, 28 parallel to rails 9, 10.

Figure 3:
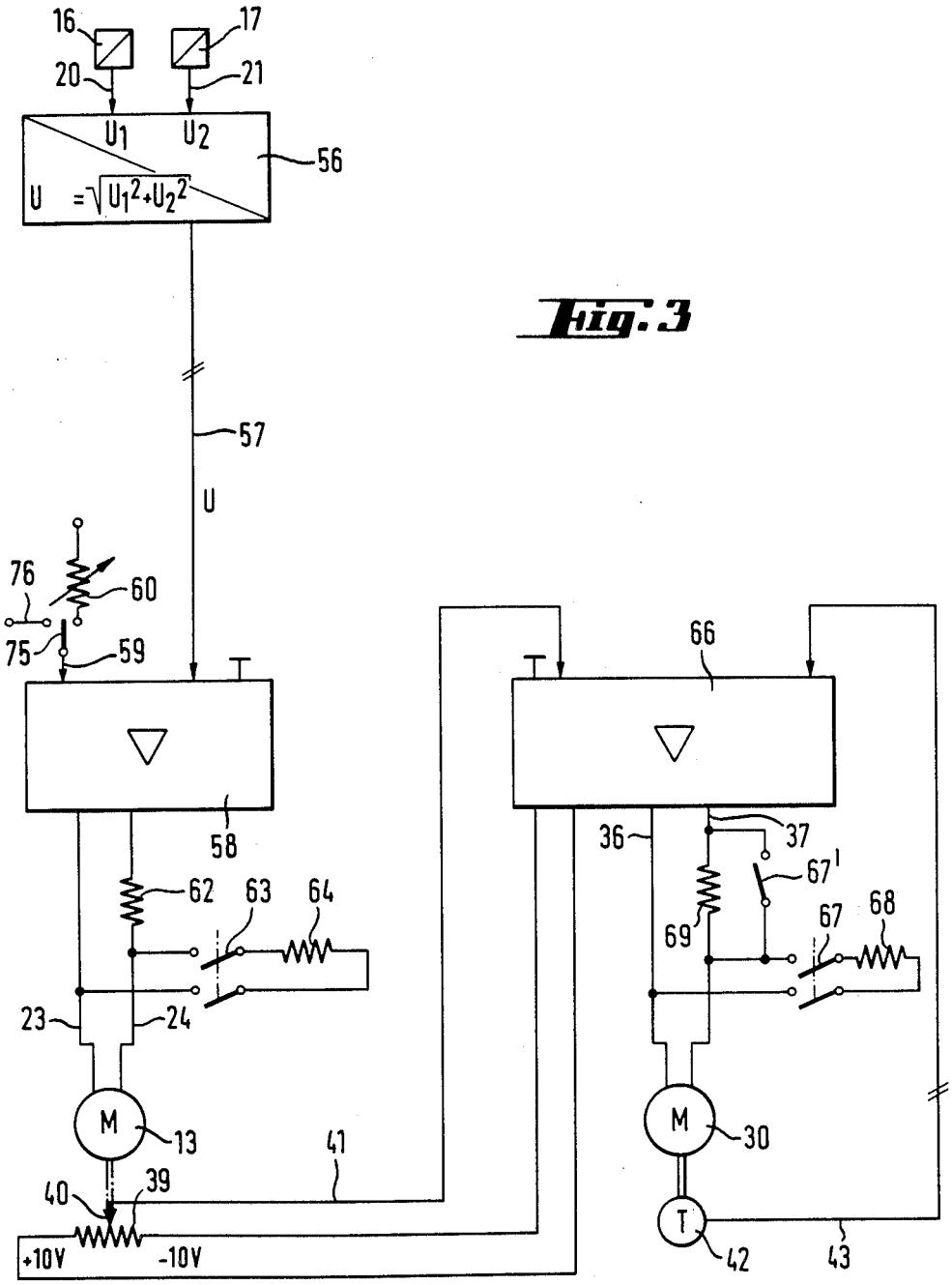
FIG. 3 is a block diagram of two adjustment circuits for control of grinding pressure and positioning of the toolholder.

Grinding pressure is generated by a pressing device which comprises a constant-torque motor 13 such as a dc slip ring motor mounted on carriage 26. Motor 13 is controlled by a dc voltage on lines 23, 24 from an adjustment circuit described in conjunction with FIG. 3. The pressure is transmitted to carriage 8 by crank 14, a connecting rod 15 connected to crank 14, a manometer capsule 16 and finally a connecting rod 12 which is hinged on carriage 8.

Rails 27, 28 are mounted on frame 34 so that carriage 26 can move linearly relative to the axis of rotation 4. Carriage 26 is coupled by a drive pin 32 to a toothed belt 31 running between a transmission gear wheel 33 and a positioning motor 30 both of which are fixed on a frame 34 of the machine. Rotation of the motor is converted by the belt into linear movement in the direction indicated by double arrow F. Positioning motor 30 is controlled by a voltage signal on lines 36, 37 from an adjustment circuit detailed in FIG. 3.

A speed control shown in FIG. 2 maintains the peripheral speed of the edge of the glass sheet approximately constant in relation to the grinding tool so that the grinding feed rate is approximately constant. If the speed of rotation of table 3 is constant, the grinding feed rate depends on the distance between the grinding tool and axis of rotation 4 of rotary table 3. To compensate for this variation in feed rate with radius, rotary table 3 is driven by a motor 45 whose speed of rotation is adjusted as a function of the distance of the grinding tool from the axis of rotation 4. The adjustment circuit of motor 45 comprises a tachometer 52 coupled to the drive shaft of motor 45, an adjustment amplifier 50, a linear potentiometer 46 mounted on frame 34 of the machine, and a potentiometer wiper 47, mounted on positioning carriage 26. Voltages of +10 volts and zero volts are applied to the ends of the potentiometer; and the voltage tapped by the wiper provides one input to adjustment amplifier 50 via a line 48 and a switch 49. If we ignore changes in the position of toolholder carriage 8 relative to positioning carriage 26 because of changes in grinding pressure, the position of wiper 47 on potentiometer 46 is a measure of the radial distance of grinding wheel 6 from the axis of rotation of table 3. As a result, the voltage tapped by the wiper is a measure of the desired speed of rotation of table 3. Tachometer 52 produces a voltage representative of the actual speed of the motor that is fed to another input to the adjustment amplifier via line 53. The output of the adjustment amplifier is a voltage signal that controls the speed of motor 45 via line 51.

The speed control circuit also comprises a rotation pulse generator 54 that is coupled to the shaft of rotary table 3 or of drive motor 45 and is connected to a programmable counter 55. Programmable counter 55 serves to program the angular distance through which rotary table 3 is driven for any desired period of grinding operation. Thus, if only a part of edge 2 of the glass sheet is to be ground, a number may be set in counter 55 so as to grind an angular distance less than 360°. Likewise, it is also possible to set a number large enough to choose an angular distance greater than 360° when it is desired to obtain broad coverage or overlapping of the grinding path. Counter 55 controls the position of switches 49, 75 so that during grinding line 48 is connected to adjustment amplifier 50 by switch 49 and potentiometer 60 is connected to adjustment amplifier 58 by switch 75. During grinding, counter 55 is decremented by pulses from pulse generator 54 until the counter reads zero whereupon switch 49 is opened and switch 75 is connected to line 76.

The adjustment circuits for constant-torque motor 13 and for positioning motor 30 are similar to the speed control circuit for motor 45. Since edge 2 of the glass sheet constantly changes its relative position during rotation of the glass sheet around axis 4 and consequently its point of impact on grinding wheel 6, two manometer capsules 16, 17 are provided to determine the actual grinding pressure, capsule 16 measuring the pressure component parallel to the direction of movement of carriage 8 and capsule 17 measuring the pressure component acting perpendicularly thereto. The manometer capsules transform measured pressure into voltage. Control voltages $U_1$, $U_2$ from manometer capsules 16, 17, respectively, are fed by lines 20, 21 to a circuit 56 (FIG. 3) which calculates the actual voltage $U_{ist}$ according to the relation $U_{ist}=U_1^2+U_2^2$. This actual voltage is fed by line 57 to an adjustment amplifier 58. The amplifier also receives on line 59 a preselected desired voltage from potentiometer 60 which specifies the desired grinding force. This voltage may be adjusted by adjustment potentiometer 60.

Amplifier 58 generates an output voltage which adjusts the pressure exerted by motor 13 until it equals that specified by potentiometer 60. The output of amplifier 58 is applied to motor 13 via lines 23, 24. A current limiting resistance 62 is inserted on line 24 to simulate an electromotive force for adjustment amplifier 58 during running, since the constant-torque motor 13 does not provide the necessary electromotive force. A load resistance 64 is coupled by a switch 63 in parallel with constant-torque motor 13. Switch 63 is closed at the beginning of the grinding operation, i.e., during the starting phase, and is intended to reduce the voltage supplied to constant-torque motor 13 so that contact between the grinding tool and the edge of the glass sheet is made gently. After this starting phase, i.e., when the grinding operation itself actually begins, the switch is opened.

The movements of carriage 8 generated by constant-torque motor 13 produce adjustments in the position of carriage 26. A circuit for the adjustment of carriage 26 comprises a tachometer 42 and a distance to voltage converter 39 mounted on carriage 26. Illustratively, the converter is a linear potentiometer to which a positive voltage, for example, +10 V, is applied at one end and a negative voltage, for example, −10 V, at the other end. A potentiometer wiper 40 is mounted on toolholder carriage 8. If wiper 40 is moved in one direction or other from a null point at the center of potentiometer 39, a positive or negative voltage will then be applied to it, depending on the direction of movement of the wiper. This voltage is fed via line 41 as a desired voltage to one input of an adjustment amplifier 66, which controls the coarse positioning of the positioning carriage 26. Tachometer generator 42 is coupled mechanically to the positioning motor and provides to another input to adjustment amplifier 66 an actual voltage through line 43.

Amplifier 66 generates an operating voltage signal which causes positioning motor 30 to move carriage 26 so that the null point at the center of potentiometer 39 is moved toward wiper 39, thereby reducing the desired voltage signal. The operating voltage signal is conducted by lines 36 and 37 from adjustment amplifier 66 to positioning motor 30. As in the case of motor 13, a load resistance 68 is coupled by switch 67 in parallel to positioning motor 30; and a current limiting resistance is inserted in line 37. Like resistance 64, resistance 68 is switched on during the starting phase of the operation and switched off as soon as the grinding itself starts so that contact between the grinding tool and the edge of the glass sheet is made gently. Current limiting resistance 69 is shortcircuited at the end of the starting phase by switch 67', simultaneously with the opening of switch 67.

Before the grinding operation begins, grinding wheel 6 is not in contact with the edge of the glass sheet. As a result, when the machine is started by closing switch 49 and connecting switch 75 to potentiometer 60, manometer capsules 16, 17 measure zero pressure and produce output voltages of zero so that the actual voltage $U_{ist}$ is zero. The desired voltage supplied from potentiometer 60 therefore causes constant torque motor 13 to drive carriage 8 to its forward position closest to rotary table 3. This advances wiper 40 of potentiometer 39 so that it receives a full negative voltage. Consequently positioning motor 30 will receive this maximum voltage and carriage 26 is moved toward glass sheet 1 at maximum speed. The operation of adjusting the constant torque motor 13 begins at the time of contact between grinding wheel 6 and the edge of the glass sheet. At this point, an actual voltage is generated by capsules 16, 17 causing toolholder carriage 8 to slide back on carriage 26; and wiper 40 to swing around to its central position on potentiometer 39. The adjustment circuit of FIG. 3 then adjusts positioning motor 30. As discussed in conjunction with FIG. 2, during the grinding operation, the speed of rotation of rotary table 3 is adjusted solely by means of potentiometer 46 and wiper 47.

When the grinding operation is completed, i.e., when rotary table 3 has traveled the angular distance predetermined by preset counter 55, switch 49 is opened and switch 75 is connected to line 76. As a result, the voltage signal on line 59 corresponding to the desired grinding force of adjustment amplifier 58 is reduced to a value that represents a desired grinding force of zero. This causes constant torque motor 13 to reduce the grinding force to zero by drawing carriage 8 back from the glass sheet. Thus, wiper 40 is simultaneously moved back to the end position on potentiometer 39 and positioning motor 30 moves positioning carriage 26 back in the same direction in an effort to null the output voltage on wiper 40. The grinding cycle is then completed and glass sheet 1 can be removed and replaced by another glass sheet.

The embodiment shown in FIG. 4 differs from that shown in FIGS. 1 and 2 in that the grinding apparatus is designed for rotary rather than linear movement. Thus, a grinding tool, represented by grinding wheel 6, is not placed on a toolholder carriage with linear movements but is placed at the end of a swinging arm 71 which rotates around axis 72. As a result, grinding tool 6 is guided on a circular path.

The apparatus further comprises a constant torque motor 13 and a positioning motor 30 which operate in analogous fashion to constant torque motor 13 and positioning motor 30 of FIGS. 1 and 2. Motor 13 is rigidly mounted on a table 73 and its rotor is connected to swinging arm 71 so as to rotate it about axis 72. The drive shaft of positioning motor 30 is rigidly connected to table 73 so as to move it through angular distance E necessary for positioning. As a result, motor 13 produces the adjusted grinding pressure; and angular movement of motor 13 and table 73 by motor 30 provide positioning. A pressure adjusting circuit again comprises two manometer capsules 16, 17 placed between hinged arm 71 and the toolholder as well as a calculating circuit 56, an adjustment amplifier 58 and a set point potentiometer 60, from which the desired grinding pressure may be selected.

As in the embodiment of FIGS. 1 and 2, adjustment of positioning motor 30 is obtained by means of a potentiometer 39 which produces the desired voltage, a tachometer 42, which generates the actual voltage, and an adjustment amplifier 66. In this case, however, potentiometer 39 is formed by a rotary potentiometer so that the resistance body of potentiometer 39 is mounted on table 73 and wiper 40 is mounted on swinging arm 71. Control of table 73 by positioning motor 30 and adjustment of the grinding pressure by constant torque motor 13 are performed exactly as described for the first embodiment in FIG. 3.

Adjustment of the speed of rotation of table 3 is performed just as described for FIG. 2; but in this case, potentiometer 46, which gives the coarse positioning set point, is a rotary potentiometer whose wiper 47 is mounted to the hinged arm 71, about its axis of rotation. Switches 49, 75 are again controlled by preset counter 55. As a result, when the grinding operation has been completed, potentiometer 60 is disconnected from line 59, effectively introducing a new desired grinding pressure of zero to adjustment amplifier 58 so that constant torque motor 13 of the grinding tool is drawn away from the edge of the glass sheet.

The desired voltage provided by potentiometer 60 can be modified in certain cases according to a preset program. Such a modification of the grinding pressure during grinding is necessary, for example, when glass sheets are to be ground that exhibit sharp or rounded angles. In these cases, a slight grinding pressure should be used for the angles. A suitable programming arrangement comprises a series of potentiometers adjusted according to different set points which, as a function of the position of the grinding tool along the periphery of the glass sheet, are switched on and off consecutively and thus provide different set points to line 59. Such a programming device is described in detail in patent document EP 0 084 506.

What is claimed:

1. Apparatus for grinding the edges of a glass sheet comprising:

a rotary table upon which a glass sheet may be placed, means for driving the rotary table, a positioning carriage, a positioning motor for moving the positioning carriage, a toolholder mounted on the positioning carriage and movable in a direction toward the rotary table, a grinding tool mounted on the toolholder, means for pressing the grinding tool against the edge of the glass sheet with a constant grinding pressure, at least one pressure measuring device for measuring pressure exerted by the grinding tool against the glass sheet, and a first distance to voltage converter for determining the relative movement between the toolholder and the positioning carriage, said first converter producing an output voltage which serves as a regulating value for the positioning motor of the positioning carriage.

2. The apparatus of claim 1 further comprising a second distance to voltage converter for determining the relative movement between the positioning carriage and the axis of rotation of the rotary table, said second converter producing an output voltage which serves as a regulating value for the means for driving the rotary table.

3. The apparatus of claim 2 characterized in that the voltage produced by the second distance to voltage converter is dependent on the radial distance between the positioning carriage and the axis of rotation of the rotary table.

4. The apparatus of claim 2 characterized in that the second distance to voltage converter is a potentiometer, the resistance body of which is mounted on a frame and the wiper of which is mounted on the positioning carriage.

5. The apparatus of claim 2 characterized in that the means for driving the rotary table comprises a motor and an adjustment circuit fed by the output of the second distance to voltage converter, whereby the peripheral speed of the edge of the glass sheet is kept approximately constant in relation to the grinding tool.

6. The apparatus of claim 1 characterized in that the first distance to voltage converter has a set point at which no regulating voltage is delivered to the positioning motor, and which in the case of a position deviating in one direction from the set point delivers a positive regulating voltage, and which in the case of a position deviating in the other direction from the set point delivers a negative regulating voltage to the positioning motor.

7. The apparatus of claim 1 characterized in that the first distance to voltage converter is a potentiometer, the resistance body of which is mounted on the positioning carriage and the wiper of which is mounted on the toolholder.

8. The apparatus of claim 1 characterized in that the toolholder is linearly shiftable on the positioning carriage and the positioning carriage is also linearly shiftable on a frame in a direction parallel to the direction of movement of the toolholder, whereby the movements of the toolholder and the positioning carriage are superimposed.

9. The apparatus of claim 1 characterized in that the toolholder is an arm mounted to swing about a rotational axis of the positioning carriage and said positioning carriage is movable by the positioning motor in a rotational movement, whereby the movements of the swinging arm and the positioning carriage are superimposed.

10. The apparatus of claim 1 characterized in that the means for pressing the grinding tool against the edge of the glass sheet with a constant grinding pressure comprises a constant torque motor.

11. The apparatus of claim 1 characterized in that prior to the starting phase of a grinding cycle, a load resistance is connected in parallel to the positioning motor whereby the positioning carriage is gently moved towards the edge of the glass sheet.

12. The apparatus of claim 1 characterized in that prior to the starting phase of a grinding cycle, a load resistance is connected in parallel to the constant torque motor whereby the toolholder is gently moved towards the edge of the glass sheet.

* * * * *